US010092088B2

(12) United States Patent
Carrera Gonzalez

(10) Patent No.: US 10,092,088 B2
(45) Date of Patent: Oct. 9, 2018

(54) FURNITURE HAVING A PULL-OUT WORKTOP

(71) Applicant: Pöttker GmbH, Lippstadt (DE)

(72) Inventor: Daniel Carrera Gonzalez, Lippstadt (DE)

(73) Assignee: Pöttker GmbH, Lippstadt (DE)

( * ) Notice: Subject to any disclaimer, the term of this patent is extended or adjusted under 35 U.S.C. 154(b) by 0 days.

(21) Appl. No.: 15/633,922

(22) Filed: Jun. 27, 2017

(65) Prior Publication Data

US 2017/0367475 A1 Dec. 28, 2017

(30) Foreign Application Priority Data

Jun. 27, 2016 (DE) ..... 20 2016 103 392

(51) Int. Cl.

| | |
|---|---|
| ***A47B 1/05*** | (2006.01) |
| ***A47B 1/10*** | (2006.01) |
| ***A47B 17/06*** | (2006.01) |
| ***A47B 63/04*** | (2006.01) |

(52) U.S. Cl.

CPC ..... *A47B 1/05* (2013.01); *A47B 1/10* (2013.01); *A47B 17/065* (2013.01); *A47B 63/04* (2013.01)

(58) Field of Classification Search

CPC ..... A47B 11/00; A47B 13/081; A47F 5/0087
USPC .... 108/140, 138, 139, 137, 143, 93, 94, 103
See application file for complete search history.

(56) References Cited

U.S. PATENT DOCUMENTS

| | | | | | |
|---|---|---|---|---|---|
| 332,360 | A | * | 12/1885 | Penney | A47B 88/06 108/140 |
| 1,729,221 | A | * | 9/1929 | Krema | A47B 1/02 108/63 |
| 1,742,904 | A | * | 1/1930 | Follmer | A47B 3/083 108/103 |
| 2,037,919 | A | * | 4/1936 | Poe | A47B 17/03 108/140 |
| 2,118,620 | A | * | 5/1938 | Orsenigo | A47B 1/02 108/103 |
| 2,293,496 | A | * | 8/1942 | Egger | A47B 1/00 108/140 |
| 2,604,369 | A | * | 7/1952 | Phillips | A47B 35/00 108/139 |
| 3,224,391 | A | * | 12/1965 | Cooper | A47B 11/00 108/140 |
| 3,479,632 | A | * | 11/1969 | Galles | H01R 39/00 248/349.1 |
| 4,687,167 | A | * | 8/1987 | Skalka | A47B 21/0314 108/103 |
| 5,425,313 | A | * | 6/1995 | Rowan | A47B 1/00 108/140 |
| 5,460,105 | A | * | 10/1995 | Given, Jr. | A47B 11/00 108/137 |

(Continued)

FOREIGN PATENT DOCUMENTS

| | | | |
|---|---|---|---|
| DE | 202015000560 | U1 | 4/2016 |
| EP | 2422648 | A1 | 2/2012 |
| WO | 2015/155701 | A1 | 10/2015 |

*Primary Examiner* — Jose V Chen
(74) *Attorney, Agent, or Firm* — Richard M. Goldberg

(57) ABSTRACT

A piece of furniture includes a base plate (12) formed by a top of a furniture body (10), and a worktop (14) adapted to be pulled-out, in which the worktop (14) covers at least a part of the base plate (12) and is slidably guided on a mounting plate (18) which is rotatably supported on the body (10) so as to be rotatable about a vertical axis (A).

12 Claims, 4 Drawing Sheets

(56) References Cited

U.S. PATENT DOCUMENTS

| | | | | | |
|---|---|---|---|---|---|
| 5,562,049 | A * | 10/1996 | Hoffman | A47B 17/065 | 108/94 |
| 5,622,118 | A * | 4/1997 | Rowan | A47B 1/00 | 108/140 |
| 7,296,523 | B1 * | 11/2007 | Yoon | A47B 95/00 | 108/103 |
| 7,836,834 | B2 * | 11/2010 | Brault | A47B 13/003 | 108/140 |
| 8,082,857 | B2 * | 12/2011 | George | A61B 5/0002 | 108/49 |
| 9,010,256 | B2 * | 4/2015 | Brennan | A47B 21/0314 | 108/103 |
| 2010/0146736 | A1 * | 6/2010 | Oshima | A63F 13/08 | 16/354 |
| 2012/0199051 | A1 * | 8/2012 | Edinger | A47B 5/006 | 108/139 |
| 2012/0298017 | A1 | 11/2012 | Chen | | |

* cited by examiner

FURNITURE HAVING A PULL-OUT WORKTOP

BACKGROUND OF THE INVENTION

The invention relates to a piece of furniture comprising a base plate that is formed by a top of a furniture body, and a worktop adapted to be pulled-out.

SUMMARY OF THE INVENTION

It is an object of the invention to provide a piece of furniture of this type which offers a high viability in the configuration of the base plate and the worktop.

In order to achieve this object, according to the invention, the worktop covers at least a part of the base plate and is slidably guided on a mounting plate which is rotatably supported on the body so as to be rotatable about a vertical axis.

In the pulled-out position, the worktop may be arranged such that it prolongs the base plate. However, by rotating the mounting plate, the worktop may also be brought into a position in which it forms a right angle or optionally any other angle with the base plate while the worktop is still slidable relative to the mounting plate even in the rotated position, so that a large number of different configurations of the base plate and the worktop may be obtained. In this way, the configuration may be adapted to the labor to be done. It is also possible to change the amount of overlap between the worktop and the base plate and, consequently, the overall size of the available support surface.

The furniture according to the invention is particularly suited for a kitchen or office designs involving a so-called "island" solution wherein the furniture is not installed adjacent to a wall but stands free in a room.

Useful further developments of the invention are indicated in the dependent claims.

In an advantageous embodiment the worktop is dimensioned such that it covers the base plate completely in at least one configuration. In this configuration the furniture has a smallest possible footprint, so that the space around the furniture may be used for other purposes. In a preferable embodiment the worktop and the base plate are congruent.

When the worktop and the base plate have each a rectangular shape, the vertical axis of rotation is preferably arranged such that it passes through a center line of the base plate and is spaced apart from one of the smaller sides of the base plate by a distance that is equal to half the width of the worktop. Then, if the worktop is rotated relative to the base plate by 90°, an edge of the worktop is flush with an edge of the base plate so that a T- or L-shaped configuration is obtained.

One end of the worktop may have a leg with which it is supported on the ground. Then, the pull-out length of the worktop is preferably so large that the spacing between the leg and the vertical axis of the rotation may assume a value that is larger than a spacing between the axis of rotation and one corner of the base plate, so that the leg will not abut at the base plate when the worktop is rotated.

Pull-out guides for slidably guiding the worktop on the mounting plate, as well as the mounting plate itself, may be accommodated completely or partly in recesses formed on a bottom side of the worktop, so that only a minimal gap exists between the worktop and the base plate in the vertical direction.

A rotary bearing for the mounting plate may have stops for limiting the angle of rotation. Moreover, the rotary bearing may have detents in which the mounting plate may snap-in in preferred angular positions of the worktop, e.g. at angles of 0° or 90°.

BRIEF DESCRIPTION OF THE DRAWINGS

An embodiment example will be described in conjunction with the drawings, wherein.

DETAILED DESCRIPTION

Figure 1:
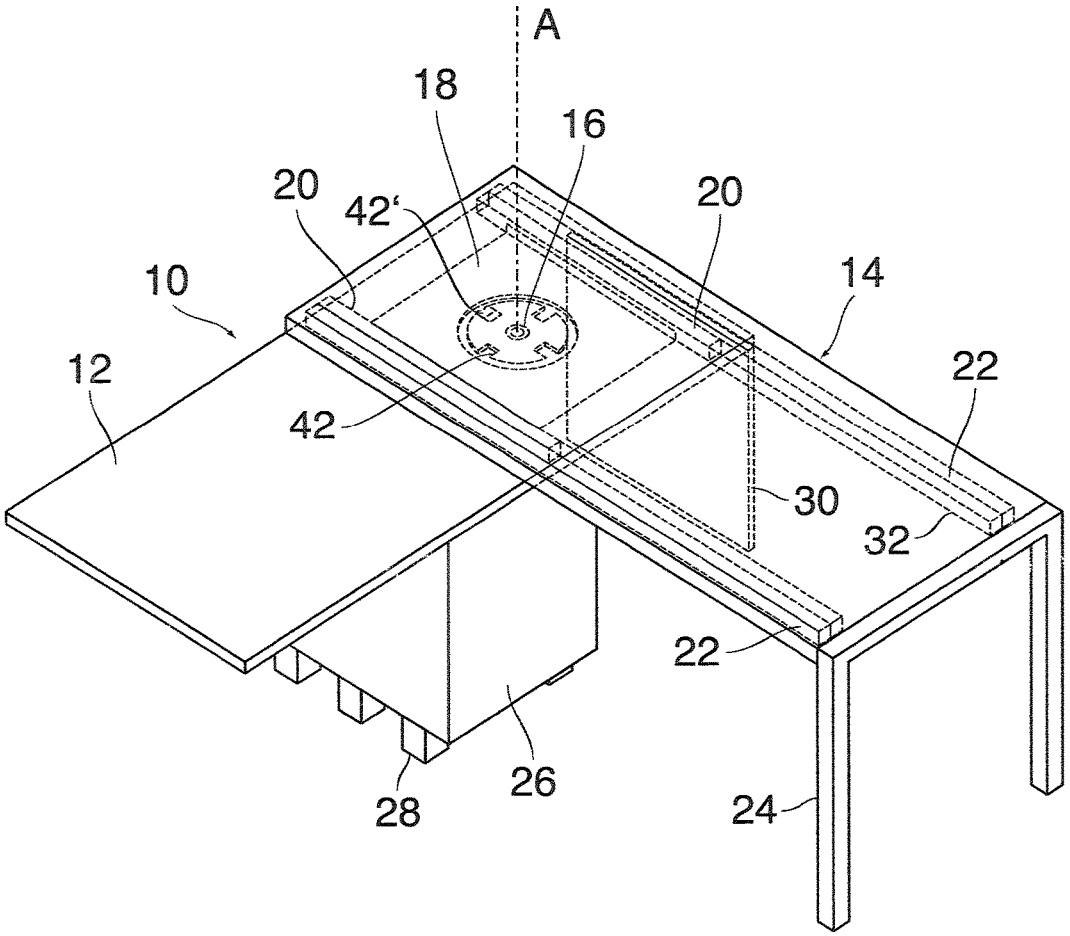
FIG. 1 is a perspective view of a piece of furniture according to the invention.

The piece of furniture shown in FIG. 1 has a body 10 a top side of which is formed by a rectangular base plate 12. A portion of the base plate 12 is covered by a worktop 14 which has also a rectangular shape and is arranged at right angles to the base plate 12 in the configuration shown here.

In the portion of the body 10 that is covered by the worktop 14, a rotary bearing 16 has been formed for bearing an approximately quadratic mounting plate 18 which extends directly above the top side of the base plate and is rotatable relative to the body about a vertical axis A that is defined by the rotary bearing 16.

Guide rails 20 are arranged along opposite edges of the mounting plate 18, and pull-out rails 22 are guided along a respective outboard side of each of the guide rails, the pull-out rails being secured to the bottom side of the worktop.

In the example shown the worktop 14 has a leg 24 which is rigidly attached to the worktop and is shaped as an inverted U-bow a horizontal top leg of which is aligned with and engages an edge of the worktop 14 at a smaller side thereof. The worktop 14 may therefore have a relatively large length without incurring a risk that the furniture will tilt when a load rests on the projecting part of the worktop 14. In the example shown the length of the worktop 14 is more than twice the width thereof.

In the example shown the body 10 has a box-shaped cupboard or container 26 which is supported on the ground with legs 28 and beyond which the base plate 12 projects on both sides. Disposed on one end of the base plate 12 is a side wall 30 by which this end of the base plate is supported on the ground, whereas the opposite end projects in cantilever fashion. A high tilt stability of the furniture is obtained due to the fact that the weight of the worktop acts as a counterbalance weight when a load is applied to the projecting part of the base plate 12.

Gutter-shaped recesses 32 are formed on the bottom side of the worktop 14 and extend in longitudinal direction thereof, and each recess accommodates one of the pull-out rails 22 and also forms a raceway for the associated guide rail 20 when the worktop is slid relative to the mounting plate 18.

Figure 2:
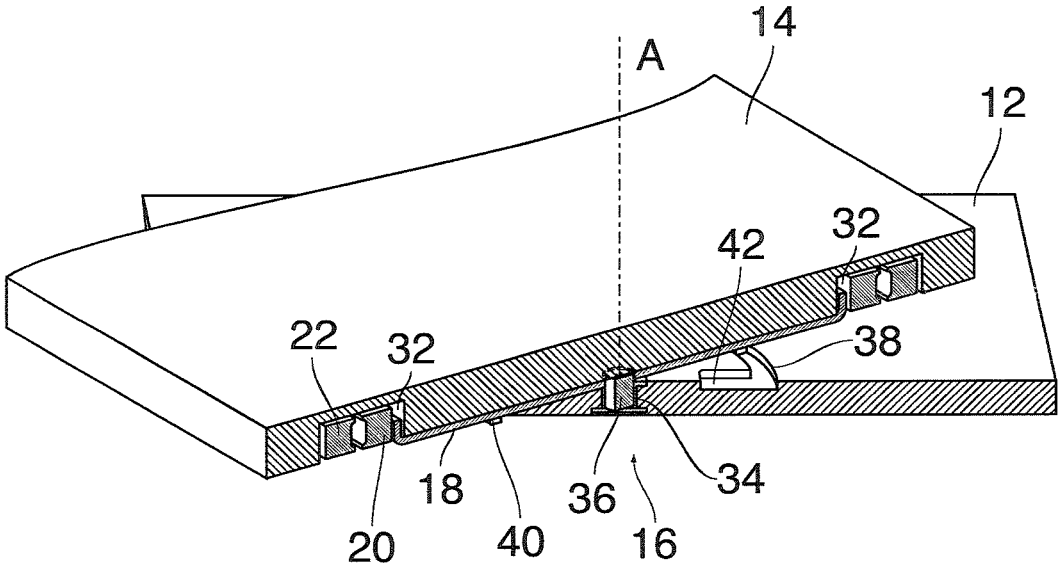
FIG. 2 is a sectional view of a base plate, a mounting plate and a worktop of the furniture according to FIG. 1.

FIG. 2 shows a cross-section of the base plate 12 and the worktop 14 in the vicinity of the rotary bearing 16.

The rotary bearing 16 has a bearing sleeve 34 which is embedded in the base plate 12 and into which engages a stud 36 that projects from the bottom side of the mounting plate 18. A circular groove 38, centered on the axis A, is formed in the top side of the base plate 12, and two diametrically opposite guide cams 40 which project from the bottom side of the mounting plate 18 engage in the groove. Four pockets 42 are formed at the inner peripheral edge of the groove 38 in angular spacings of 90°. These pockets accommodate elastic detent devices 42' (see FIG. 1) in which the cams 40 may snap-in when the worktop 14 reaches an angular position in which its edges are parallel to the edges of the base plate.

It can further be seen in FIG. 2 how the guide rails 20 and the pull-out rails 22 are accommodated in the recesses 32 of the worktop 14. The guide rails 20 are attached to upwardly bent edges of the mounting plate 18. The two recesses 32 of the worktop 14 are interconnected by a shallower recess (no reference numeral) which essentially accommodates the mounting plate 18, so that only a relatively narrow gap is formed between the bottom side of the worktop 14 and the top side of the base plate 12.

Figure 3:
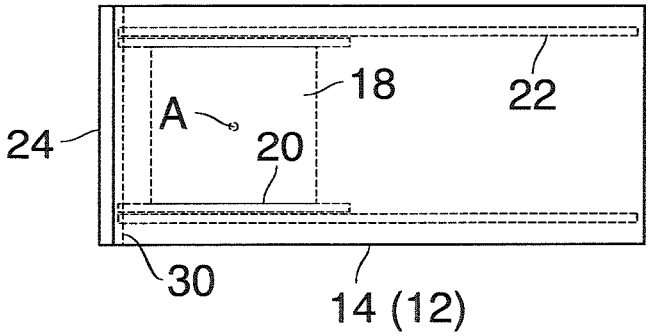
FIGS. 3 to 7 are plan views of the furniture according to FIG. 1 in different configurations.

FIG. 3 shows the furniture in a configuration in which it has the smallest footprint. In the example shown the worktop 14 (without the leg 24) is congruent to the base plate 12. In the configuration shown in FIG. 3 the baseplate 12 is entirely covered by the worktop 14. The leg 24 directly engages the side wall 30 of the body in this configuration.

Figure 4:
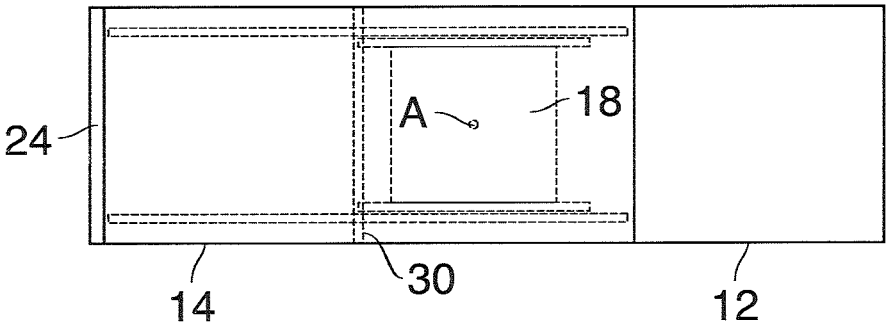

FIG. 4 shows the furniture in a configuration in which the worktop 14 has been pulled-out to the left side, so that the worktop 14 and the base plate 12 together form an increased support area.

Figure 5:
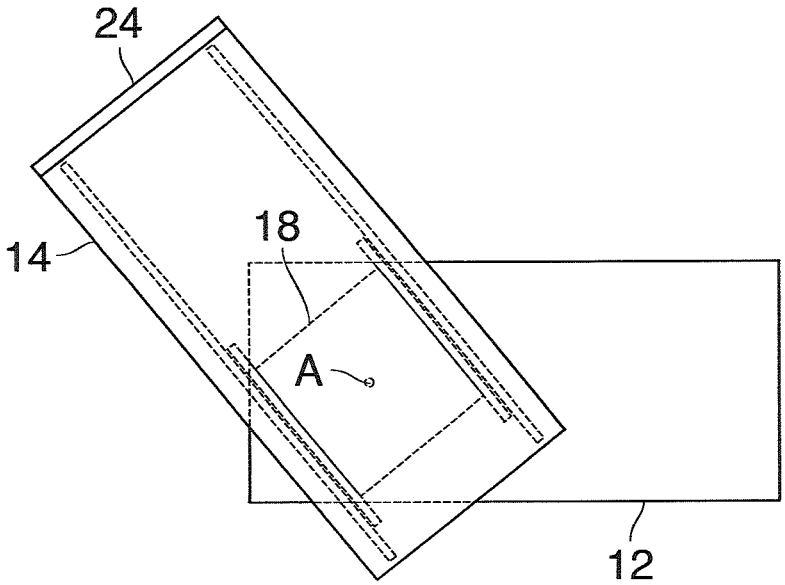

In FIG. 5 the worktop 14 has been rotated, in the pulled-out position, by an angle of approximately 45° about the axis A. The leg 24 is spaced so far away from the axis A in this configuration that it does not abut at the corner of the base plate 12.

In a modified embodiment the worktop 14 could also have a somewhat larger length than the base plate 12. In that case the pull-out length of the worktop could be so large that, in the pulled-out position, the worktop could be rotated by an angle of 360° about the axis A without abutting at the base plate 12.

Figure 6:
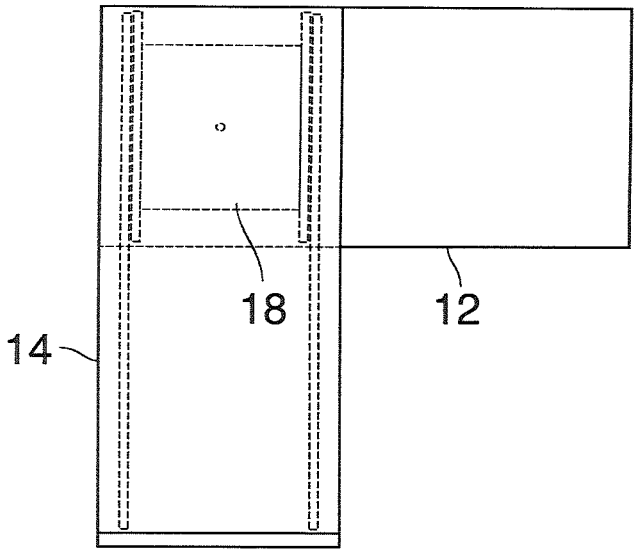

FIG. 6 shows the furniture in a configuration in which the worktop 14 is rotated by an angle of 90° relative to the base plate 12, but in opposite direction as compared to FIG. 1, so that the configuration according to FIG. 6 is the mirror image to the configuration shown in FIG. 1.

Figure 7:
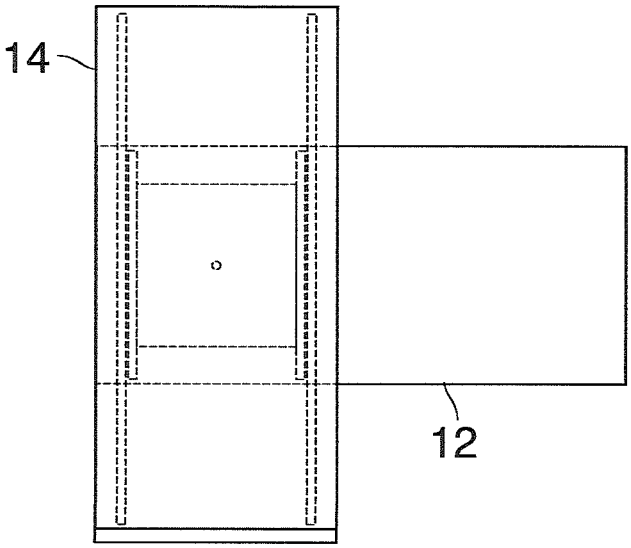

Even in this angular position, just as in any other angular position, the worktop 14 may be slid relative to the mounting plate 18. As an example, FIG. 7 shows a T-shaped configuration in which the worktop 14 has been pushed back, from the configuration shown in FIG. 6, so far that it projects beyond the baseplate 12 by equal distances on both sides.

The invention claimed is:

1. A piece of furniture comprising:

a furniture body including a base plate formed by a top of the furniture body, the furniture body including structure that provides that the furniture body is stably supported on a ground surface without any additional support, a worktop adapted to be pulled-out relative to the base plate, and a mounting plate rotatably mounted on the furniture body so as to be rotatable about a vertical axis and non-slidably mounted in a linear direction on the furniture body, and at least one rail mounted to the worktop, the worktop covering at least a part of the base plate and being slidably guided on the base plate by the rails in a linear direction and rotatably movable relative to the base plate by the mounting plate.

2. The piece of furniture according to claim 1, wherein the worktop is dimensioned such that it covers the base plate entirely in at least one configuration.

3. The piece of furniture according to claim 1, wherein the worktop and the base plate are congruent.

4. The piece of furniture according to claim 1, wherein the worktop and the base plate are each rectangular in plan view.

5. The piece of furniture according to claim 4, wherein the axis passes through a center line of the base plate and is spaced from a smaller side of this base plate by a distance that is equal to half the width of the worktop.

6. The piece of furniture according to claim 1, wherein the worktop has, at one end thereof in a pull-out direction, a leg with which it is supported on a ground surface.

7. The piece of furniture according to claim 6, wherein the worktop has a length which is at least twice a width thereof.

8. The piece of furniture according to claim 1, further comprising at least a part of a rotary bearing embedded in the base plate.

9. The piece of furniture according to claim 1, wherein the worktop has, at a bottom side thereof, at least one recess, and wherein the at least one rail includes at least one pull-out rail accommodated in the at least one recess and adapted to be slidably guided at the mounting plate.

10. The piece of furniture according to claim 9, wherein at least a portion of the mounting plate is accommodated in the recess.

11. The piece of furniture according to claim 1, further comprising:

a circular groove formed in the base plate and centered on the axis, and at least one cam provided at a bottom side of the mounting plate, the cam engaging in the circular groove.

12. The piece of furniture according to claim 11, further comprising at least one pocket formed at an inner peripheral edge of the groove, and wherein the at least one cam includes at least one detent device arranged at the groove, the at least one detent device being arranged for snap-fastening in the at least one pocket to snap-fasten the worktop in a predetermined angular position.

* * * * *